United States Patent [19]

Schwarze

[11] 4,311,031

[45] Jan. 19, 1982

[54] PIPE BENDING MACHINE

[76] Inventor: Rigobert Schwarze, Olpener Str. 460-474, 5000 Köln, Fed. Rep. of Germany

[21] Appl. No.: 59,762

[22] Filed: Jul. 20, 1979

[30] Foreign Application Priority Data

Jul. 27, 1978 [DE] Fed. Rep. of Germany ..... 2832980

[51] Int. Cl.[3] ..... B21D 7/04; B21D 9/05; B21D 43/10; B21D 43/20

[52] U.S. Cl. ..... 72/133; 72/134; 72/150; 414/225; 414/732; 414/741; 414/744 A

[58] Field of Search ..... 72/133, 134, 149, 150, 72/159, 422, 424, 426; 414/4, 729, 732, 735, 738, 741, 744 A, 745, 751, 225

[56] References Cited

U.S. PATENT DOCUMENTS

| | | | |
|---|---|---|---|
| 3,066,805 | 12/1962 | Sullivan | 414/4 |
| 3,406,836 | 10/1968 | Manetta et al. | 414/741 |
| 3,648,854 | 3/1972 | Potter | 414/744 A |
| 3,824,833 | 7/1974 | Bachmann | 414/744 A |
| 4,077,523 | 3/1978 | Spanke | 414/729 |

FOREIGN PATENT DOCUMENTS

| | | | |
|---|---|---|---|
| 794648 | 5/1958 | United Kingdom | 72/424 |
| 875428 | 8/1961 | United Kingdom | 72/424 |

*Primary Examiner*—Ervin M. Combs
*Attorney, Agent, or Firm*—Michael J. Striker

[57] ABSTRACT

A pipe bending machine has a pipe bending mechanism which receives lengths of pipe to be bent from a pipe magazine located laterally of one side of the mechanism. A pipe transfer device is interposed between the bending mechanism and the magazine and transports pipe length from the magazine to the bending mechanism, for which purpose it is so constructed that it can pivot in a plurality of mutually inclined planes.

8 Claims, 14 Drawing Figures

PIPE BENDING MACHINE

BACKGROUND OF THE INVENTION

The present invention relates to a pipe bending machine, and more particularly to an arrangement for loading and unloading a pipe bending machine.

Metallic tubes are bent in pipe bending machines either with or without the aid of a bending mandrel. This depends to some extent upon the material of the pipe and upon the degree of bending accuracy that is required. If a mandrel is used, a holder for the mandrel in form of a long rod is inserted into the pipe to be bent, and the bending mandrel is mounted on the rod so as to be located within the pipe. Such bending requires that at the head end of the pipe bending machine where the bending template is located, the pipe to be bent be pushed from in front in axial direction onto the bending mandrel and the rod holding the same, and that it be thereupon engaged by the clamping device of the pipe advancing mechanism of the bending machine. As a general rule, the clamping device is far advanced on the pipe advancing carriage of the machine; after the trailing end of the pipe has been engaged by the clamping device the same is returned with the carriage to a starting position, so that the bending operation can then begin.

If the pipe is being bent without a mandrel, then of course insertion of the pipe from the front end of the machine is not necessary. Instead, the clamping device is retracted and the pipe can then be inserted into the machine from a lateral side thereof, whereupon the clamping device is advanced to engage the pipe and the bending operation then proceeds.

The pipes to be bent are cut to a predetermined length and are taken from a pipe magazine to be sequentially placed into the pipe bending machine. The magazine is located laterally of the machine and to permit bending either with or without a mandrel, meaning that the pipes have to be capable of being inserted from one end of the machine or from one side of the machine, it is known in the prior art to make the magazine slidable lengthwise of the machine. Of course, this requires a relatively complicated construction, among other reasons because provision must be made for insertion of the pre-cut pipes into the magazine itself and to permit the magazine to move lengthwise of the machine. In addition, when the magazine is advanced to the vicinity of the head end of the machine so that the pipes can be inserted lengthwise of the machine for bending with a mandrel, the magazine tends to hinder proper bending because after the bending is partially or totally completed a portion of the pipe extends beyond the bending template and is likely to abut against or be abutted by the movable pipe magazine. To avoid this it is very often necessary, depending upon the shape imparted to a bent pipe, to move the magazine every time an individual pipe is being bent with the aid of a mandrel. Of course, having to move the magazine each and every time a pipe is being bent is time consuming and cumbersome and leads to interruptions in the proper sequence of operations, because the constant to-and-fro movement of the magazine makes it difficult to properly and precisely position the pipes being inserted into the machine.

SUMMARY OF THE INVENTION

It is an object of the present invention to overcome the disadvantages of the prior art.

More particularly, it is an object of the present invention to provide an improved arrangement for supplying pipes to be bent to a pipe bending machine, wherein the magazine is stationary with reference to the pipe bending machine, irrespective of whether the pipes are to be bent with or without the aid of a bending mandrel.

Another object of the invention is to provide such an arrangement wherein the pipes always have a precise uniform position prior to insertion into the pipe bending machine, and a precise insertion of the individual pipes into the pipe bending machine is guaranteed.

Another object is to provide such an arrangement in which an automatic removal of the bent pipe from the pipe bending machine can be effected, irrespective of the shape to which the pipes have been bent in the machine.

Pursuant to these objects, and others which will become apparent hereafter, one feature of the invention resides, in a pipe bending machine, in a combination which comprises pipe bending means for bending lengths of pipe, and a pipe magazine which is spaced laterally from one side of said pipe bending means, for holding lengths of pipe to be bent. There is further provided pipe transfer means interposed between the pipe magazine and the pipe bending means and being pivotable in a plurality of mutually inclined planes, the pipe transfer means being operative for transporting lengths of pipe from the magazine to the pipe bending means.

The device according to the present invention assures that the pipe magazine can be mounted stationarily and that the pipe transfer means can insert a length of pipe removed from the pipe magazine, into the pipe bending machine, either from one end of the same for bending with the aid of the mandrel or from laterally of the machine when bending is to be effected without use of the mandrel.

To provide for fully automatic removal of the bent pipes from the bending machine, the invention proposes to provide on the side of the bending machine remote from the location of the pipe transfer means, a device which, similarly to the pipe transfer means, is pivotable in a plurality of mutually inclined planes and has a gripper which engages the bent pipes and removes them from the pipe bending machine.

The pipe transfer means may be pivotable about a vertical axis and also about a horizontal axis and its length may be changed. It is preferably mounted on a socket or housing and can be pivoted about the horizontal axis to-and-fro in the manner of a pendulum, preferably by means of a rotary piston cylinder, and the upwardly directed pendulum mounted on or in the socket is provided with a drive which can be pivoted to-and-fro about the aforementioned vertical axis also.

The free end of the aforementioned pendulum, i.e. the elongated part of the pipe transfer means, may be provided with a gripper having a stationary jaw and a cooperating movable jaw which is movable via the piston rod of a pneumatic or hydraulic cylinder so that the pipe can be gripped between the two jaws. In addition, the jaw arrangement is preferably movable lengthwise of the pipe transfer means via a pneumatic or hydraulic cylinder provided for this purpose.

The pipe removing device may also be mounted so as to be pivotable about a vertical axis and may have two arms which are both adjustable as to their effective length, one of the arms being pivoted to the other arm to be displaceable relative thereto about a vertical axis. The change in the effective length of the first arm may be effected via a suitable hydraulic or pneumatic cylinder which engages the vertical axis of rotation of the arm and has a piston rod connected to the arm which is guided in the rail, the gripper provided at the end of the second arm also being movable by the piston rod of a hydraulic or pneumatic cylinder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
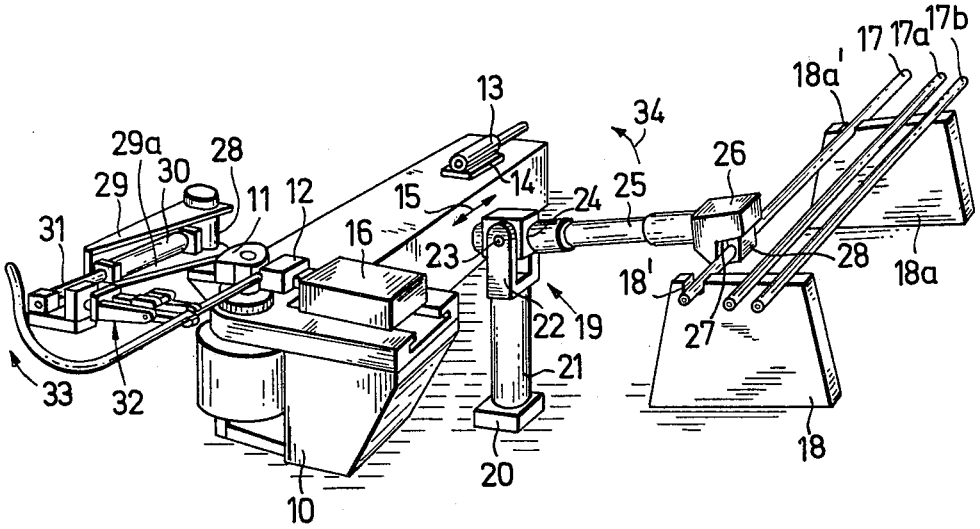
FIG. 1 is a perspective view illustrating a pipe bending machine according to the present invention.

Referring now in detail to the drawing, and firstly to FIGS. 1–4, it will be seen that the pipe bending machine has a bending table 10 provided with a bending template 11 and a clamp 12. A further clamp 13 is provided which is mounted on a carriage 14 that can be moved in a known manner in the direction indicated by the double-headed arrow 15. The template 11 and the clamp 12 as well as the drive 16 for the same, are also known from the prior art.

The pipe lengths 17, 17*a*, 17*b* to be bent are stored in a magazine which is not visible in FIG. 1 and are supplied from the same, to be placed onto supports 18, 18*a* in such a manner that the respectively forwardly or leading pipe 18 is located in depressions 18', 18*a'*, or else between appropriate abutments or the like.

The pipe transfer means 19 has a base plate 20 which is mounted on the ground and preferably is directly connected via a support with the pipe bending machine to assure that no relative displacements occur; however, it can also be mounted separately as shown in FIG. 1. The device is further provided with an upright 21 at the upper end of which there is a bifurcated member 22 having a horizontal shaft 23. A block 24 is mounted in the bifurcated member 22 so that it can pivot about the shaft 23, and a tube 25 extends from the block 24 and carries at its free end a gripper 26 having, as will be discussed with reference to FIG. 8, gripping elements 27 and 28.

Located at the other side of the pipe bending machine from the pipe transfer means, is a pipe removing device which preferably is also connected to the pipe bending machine and composed of a shaft 28 defining a vertical pivot axis, and two arms 29, 29*a* and a cylinder-and-piston unit 30 located between them and having a piston rod 31. The front end of the piston rod 31 is provided with a gripping device 32 (see FIG. 10) which is pivotable about a vertical axis and which engages the bent tube after the bending is completed and while it is still engaged between the template 11 and the clamp 12, and removes it (after loosening of the clamp 12 from the template 11) by pivoting outwardly in the direction indicated by the arrow 33, to deposit it upon a transporting carriage or the like.

As shown in FIG. 1, the device 19 engages the pipe 17 to be bent at a time at which the device at the other side of the bending machine removes the bent pipe from the machine. However, it should be understood that this is merely a diagrammatic way of representation, because in actual operation the device 19 will have the position illustrated in FIG. 3 at the time at which the bent pipe is removed from the machine, or will even be in the process of descending towards the bending machine to deposit the pipe 17 into the same. Such a sequencing and cooperation between the various elements is made possible by the invention, so that rapid operation is guaranteed.

Figure 2:
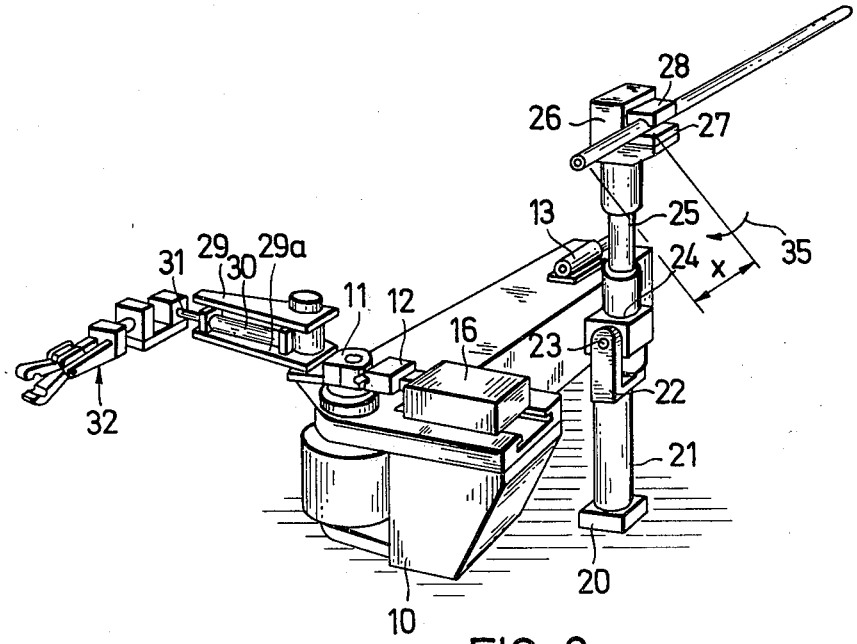
FIGS. 2–4 are respective perspective views, showing different operating stages of the machine in FIG. 1.
Figure 3:
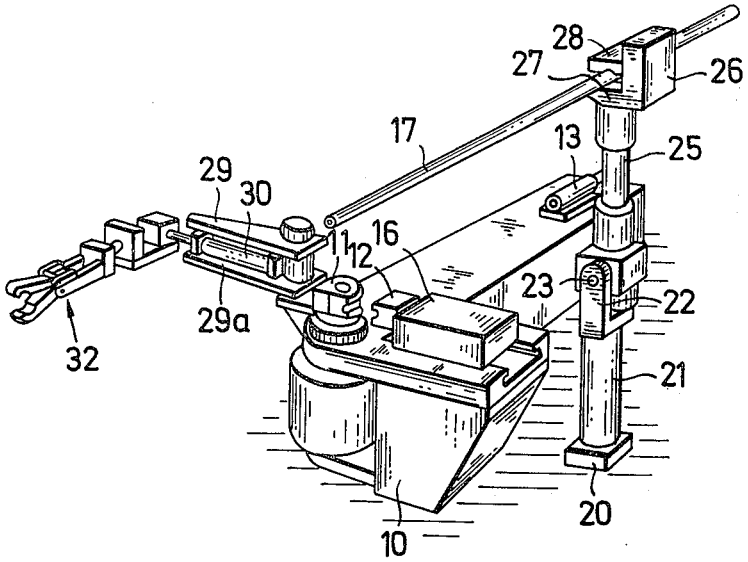
Figure 4:
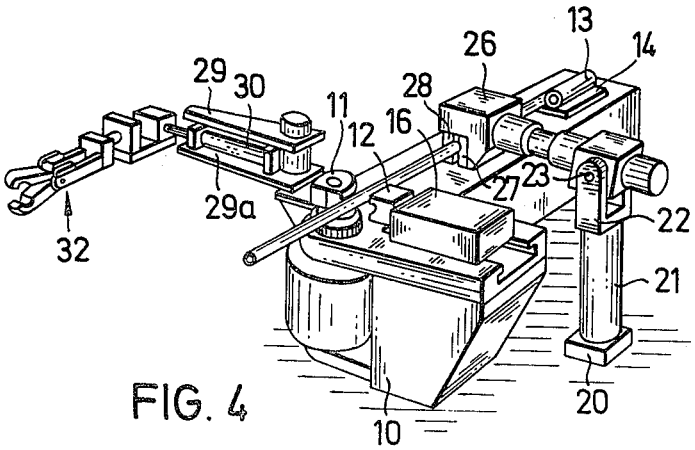

As soon as the device 19 has engaged the pipe 17 to be bent, the gripper is raised about the pivot axis 23 in the direction indicated by the arrow 34, and when the upper position shown in FIG. 2 is reached, but possibly even somewhat earlier, the upright 21 is pivoted in the direction indicated by the arrow 35 through 180°, as shown in FIG. 3. The short end of the tube 17 projecting beyond the gripper is now inserted into the pipe bending machine as shown in FIG. 4, with the bending mandrel partially retracted and with the gripper 13 also partially retracted. Thereafter, the gripper 13 is advanced forwardly in direction towards the template 11, until it sufficiently embraces the pipe 17, whereupon the gripper together with the pipe is returned into the starting position which the pipe has to assume before bending can commence.

For purposes of better illustration the insertion of the pipes is shown in FIGS. 1–4 with the gripper 13 retracted very far. In actual fact, however, the front end of the inserted pipe 17 will be located in the vicinity of the template 11, as shown in FIG. 7, when bending is to be effected with the aid of a mandrel.

FIGS. 1–4 essentially show the insertion of the pipes into the machine when bending is to be effected without the aid of a mandrel, i.e. from the side of the machine. If bending is to be effected with the mandrel, then the distance X shown in FIG. 2, is very small. This can be effected in a simple manner by having the pipes 17, 17*a*, 17*b* shifted in axial direction in the pipe magazine.

Figure 7:
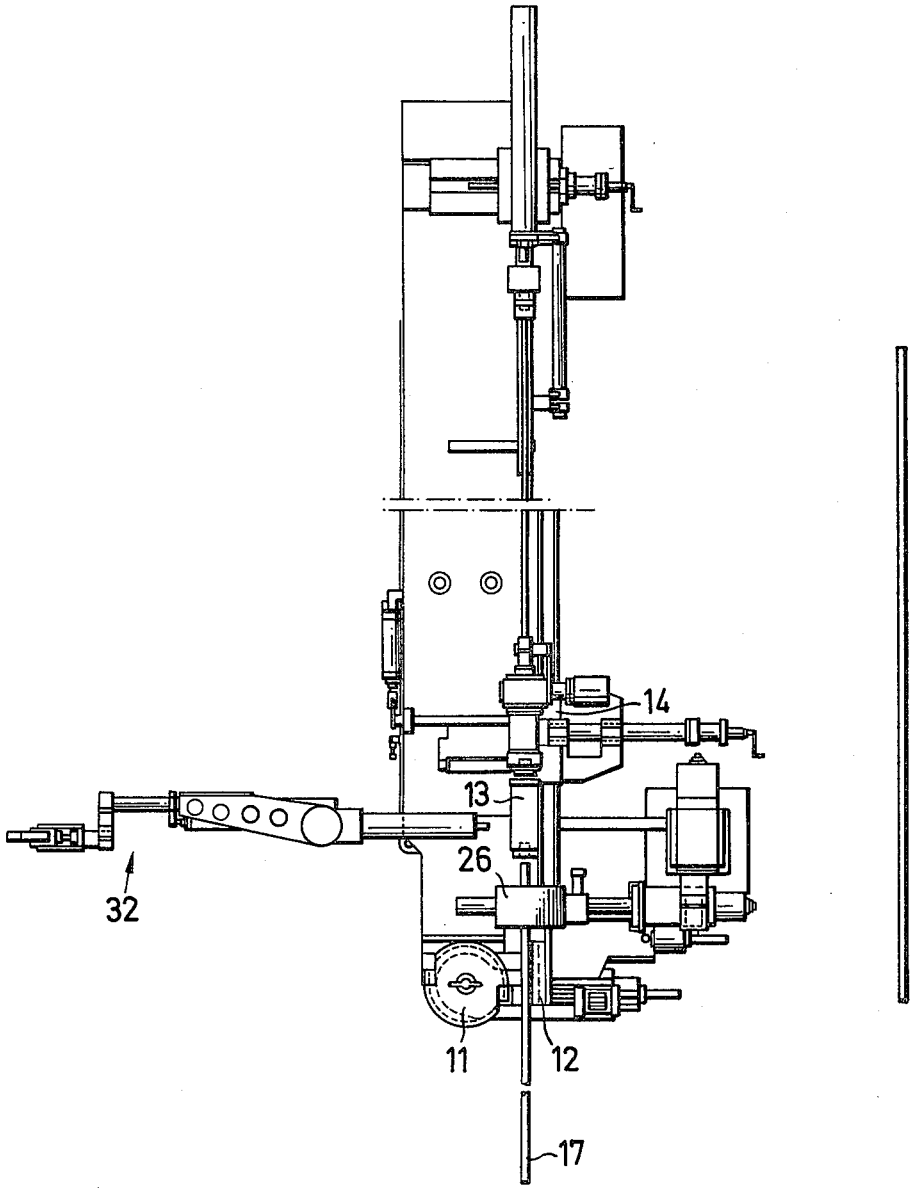
FIG. 7 is a top-plan view of the machine in FIG. 6.

When the gripper head 26 inserts the pipe into the pipe bending machine it is located not as shown in FIG. 4 for convenience, but instead as shown in FIG. 7, namely in the vicinity of the template 11. It may also be located ahead of the template, because during bending the gripper head is removed from the template by pivoting about the axis 23, so that the pipe transfer device 19 cannot hinder the bending operation.

After the pipe has been inserted into the pipe bending machine and engaged by the clamp 13 and is thus held in a precisely predetermined position, the gripping arrangement 27, 28 is disengaged and the device 19 is pivoted back to the pipe magazine in order to engage the next pipe 17 to be bent. After this movement the bending of the pipe present in the machine is effected, and at the time at which the pipe removing device removes the bent pipe from the machine, the device 19 is already in such a position that the next pipe can be inserted into the machine, so that only a very brief time interval remains between removal of the bent pipe from the machine and insertion of a new pipe to be bent into the machine. This time period can be varied, in dependence upon the pipe and material of the pipe to be bent.

Figure 5:
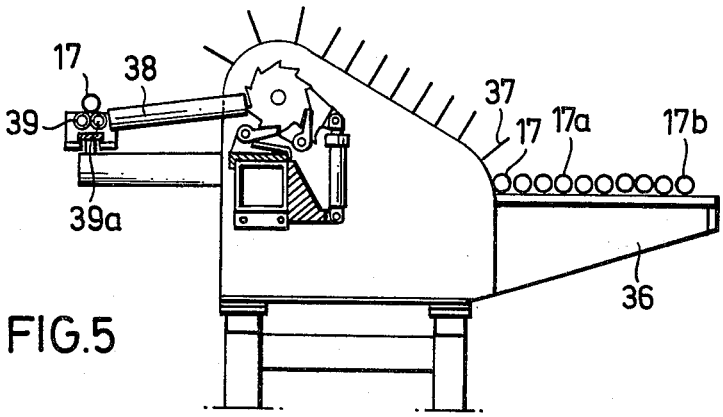
FIG. 5 is an end view of a pipe magazine of the machine in FIGS. 1–4.

The pipe magazine itself is shown in some detail in FIG. 5. It will be seen that the pipes 17, 17*a*, 17*b*, etc. are supported on a table 36 and are sequentially transported via a chain conveyor with engaging fingers 37 to a downwardly inclined track 38 on which they move onto rollers 39, 39*a* which center the respective pipes 17, 17*a*, etc. The rollers 39 and 39*a* may be provided with a sensing arrangement in order to sense the possible presence of a longitudinal welding seam on the respective pipe, and to position the welding seam in a predetermined orientation so that the device 19 always presents the tube to the pipe bending machine with the welding seam in a predetermined orientation relative to the bending template.

Figure 6:
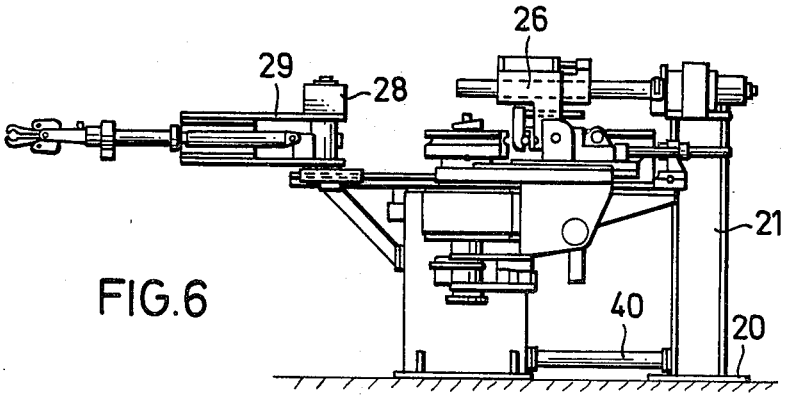
FIG. 6 is an end view of the machine in FIGS. 1–5.

FIG. 6 shows the machine of FIG. 1 in an end view, but with the difference that connecting member 40 is illustrated which connects the device 19 to the bending machine, rather than having the device 19 be mounted separately; this assures proper positioning of the device 19 with reference to the bending machine at all times.

FIG. 7 is a top-plan view of the pipe bending machine, with the gripper head 26 of the grippers 27 and 28 being located immediately adjacent the template 11 and the gripper 12. The member 13 is forwardly displaced to the vicinity of the template 11 and the pipe to be bent is still held by the gripper head 26 at this time. Subsequently, the gripper 13 is retracted to surround and engage the pipe, and thereupon the head 26 is disengaged. The gripper 13 with the carriage 14 is then moved together with the pipe to the starting position at which bending can begin. During the insertion of the pipe the bentpipe removal device 32 is pivoted outwardly away from the machine.

Figure 8:
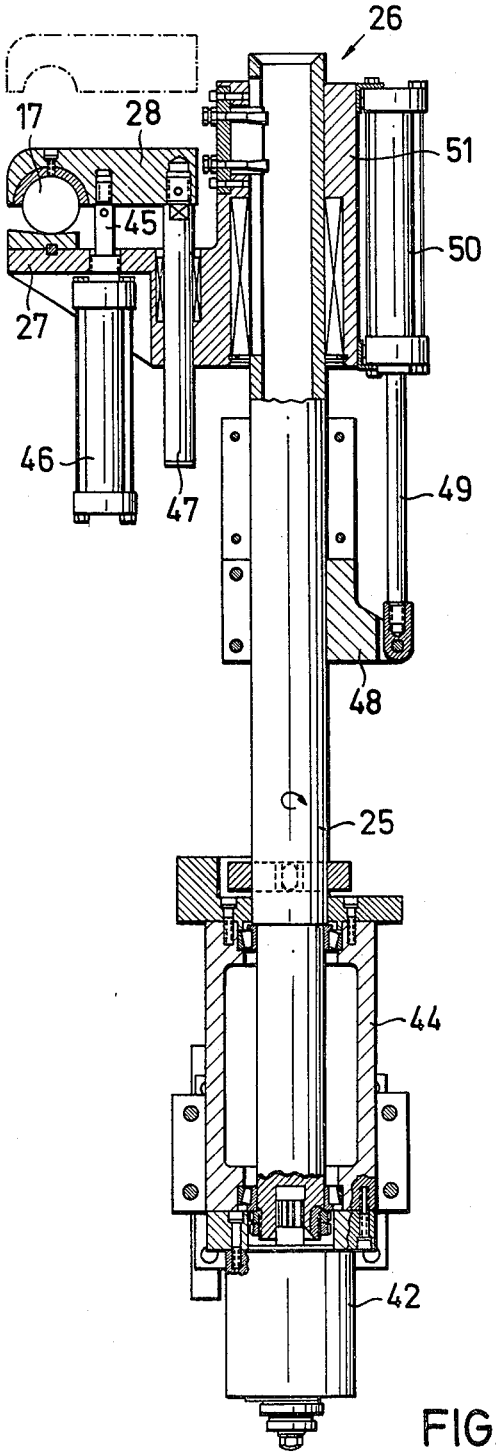
FIG. 8 is a side view, partly sectioned, of the pipe transfer means of the machine in the preceding Figures.
Figure 9:
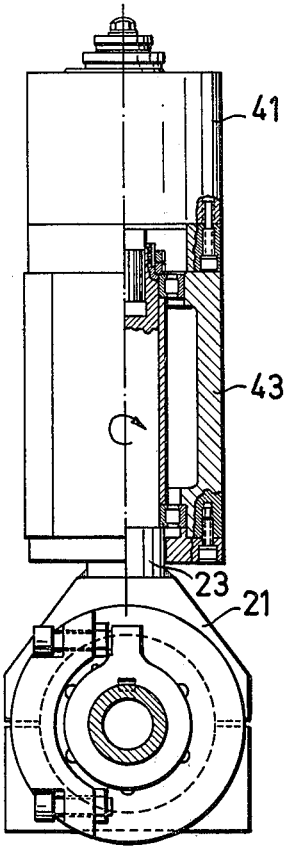
FIG. 9 is a top-plan view, partly in section, of FIG. 8.

FIGS. 8 and 9 show that the device 19 has a housing 21 which is upright and is pivotable about the horizontal axis 23 by rotary piston cylinder 41, in the manner analogous to a pendulum, but a pendulum which extends upwardly rather than downwardly. This pendulum is the member 25 which is connected with a rotary piston cylinder 42 that turns the member 25 about the vertical axis of its elongation, preferably to-and-fro. However, turning in one direction only can also be effected. The unit 41 is mounted on a housing 43 and the unit 42 in a housing 44. The member 25 has at its upper end a gripper head 26 which is composed of a fixed lower jaw 27 and a cooperating upper jaw 28 located above it. The jaw 28 is raised and lowered via the piston rod 45 of a pneumatic or hydraulic cylinder 46. The raised position is shown in broken lines. A guide 45 in form of a rod is provided which engages in a bore of the lower jaw 27. The effective length of the member 25 can be varied, for which purpose the member 25 is provided with a member 48 against which the piston rod 49 of the cylinder 50 abuts. This cylinder 50 is mounted on a housing 51 which surrounds the member 25 so that by operation of the cylinder 50 the head 26 can be axially shifted, assuring that the grippers 27, 28 which engage the pipe 17, are adjustable lengthwise of the member 25.

Figure 10:
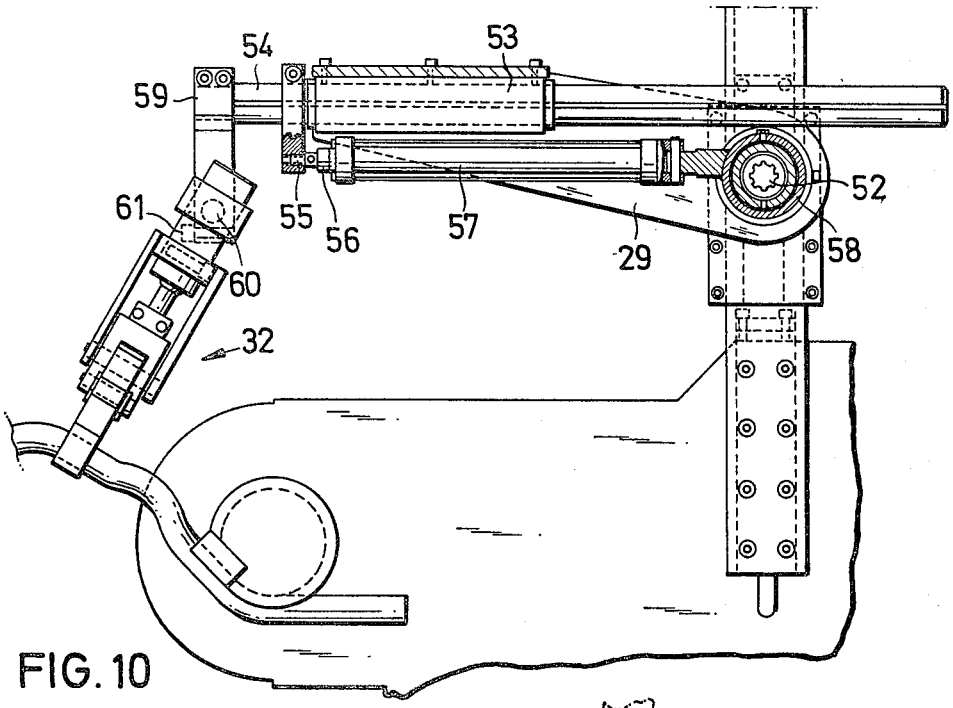
FIG. 10 is a top-plan view, partly in section, of the pipe removing arrangement of the machine in the preceding Figures.
Figure 11:
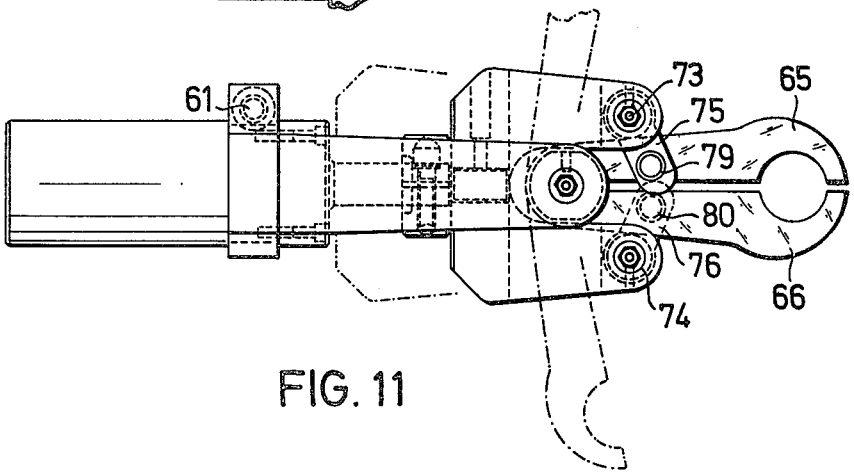
FIG. 11 is a fragmentary detail view, showing a detail of FIG. 10.
Figure 12:
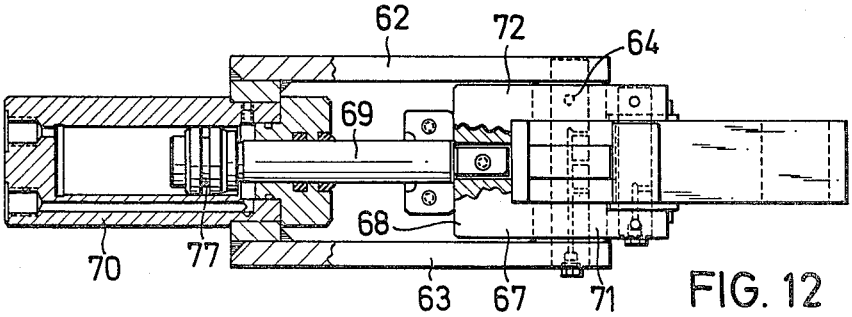
FIG. 12 is a partially sectioned top-plan view of FIG. 11.

FIGS. 10–12 show that the pipe removing device 32 is pivotable about a vertical axis 52 and is also driven by a not-illustrated rotary piston drive. The device has the arms 29 and 30 between which a guide 53 is provided in which a rail 54 of T-shaped profile is shiftable. A clamp 55 is provided on the rail 54 and the piston rod 56 of a pneumatic or hydraulic cylinder 57 is connected to the clamp 55. The cylinder 57 is mounted on the housing 58 which surrounds the vertical axis of rotation 52. By operation of the cylinder 57 the effective length of the rail 54 guided in the guide 53, can be varied. At the head end of the rail 54 a clamp 59 connects the gripping device 32, in such a manner that the same is pivotable about a vertical axis 60 and can be fixed in a predetermined angular position via a screw 61.

The gripping arrangement of the device 32 for removal of bent pipes from the pipe bending machine has two walls 62 and 63 as will be seen in FIGS. 10 and 11, which extend parallel to one another and are spaced from each other. The front ends of these walls are connected by a stationary shaft 64 to which the ends of the grippers 65 and 66 are connected. Journalled on the shaft 64 is also a U-shaped claw 67 having a transversely extending bight wall 68 that is connected with the piston rod 69 of a hydraulic or pneumatic cylinder 70. The two legs 71 and 72 of the claw 67 are connected to members 75 and 76 at their front ends via respective bolts 73 and 74. Bolts 78, 79 and 80 connect the members with the claws 65 and 66, so at each claw 65 and 66 has one of the members 75 and 76 connected to it. By operation of the cylinder 77 the claws 65 and 66 are moved towards and away from one another, and in FIG. 11 the adjacent and retracted positions are shown in broken and solid lines, respectively.

Figure 13:
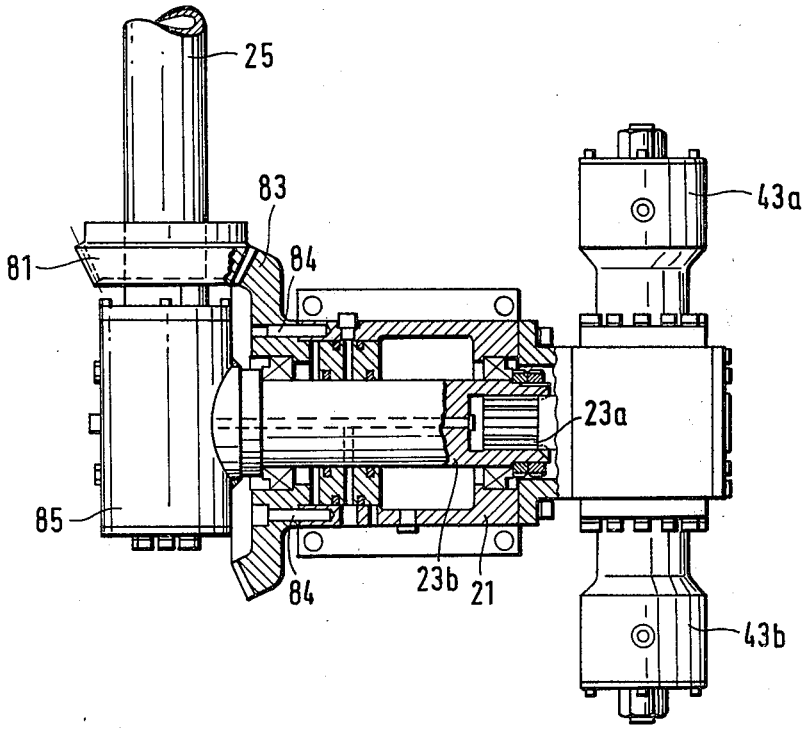
FIG. 13 is a side view, partly in section, of a modified embodiment of a pipe transfer means.
Figure 14:
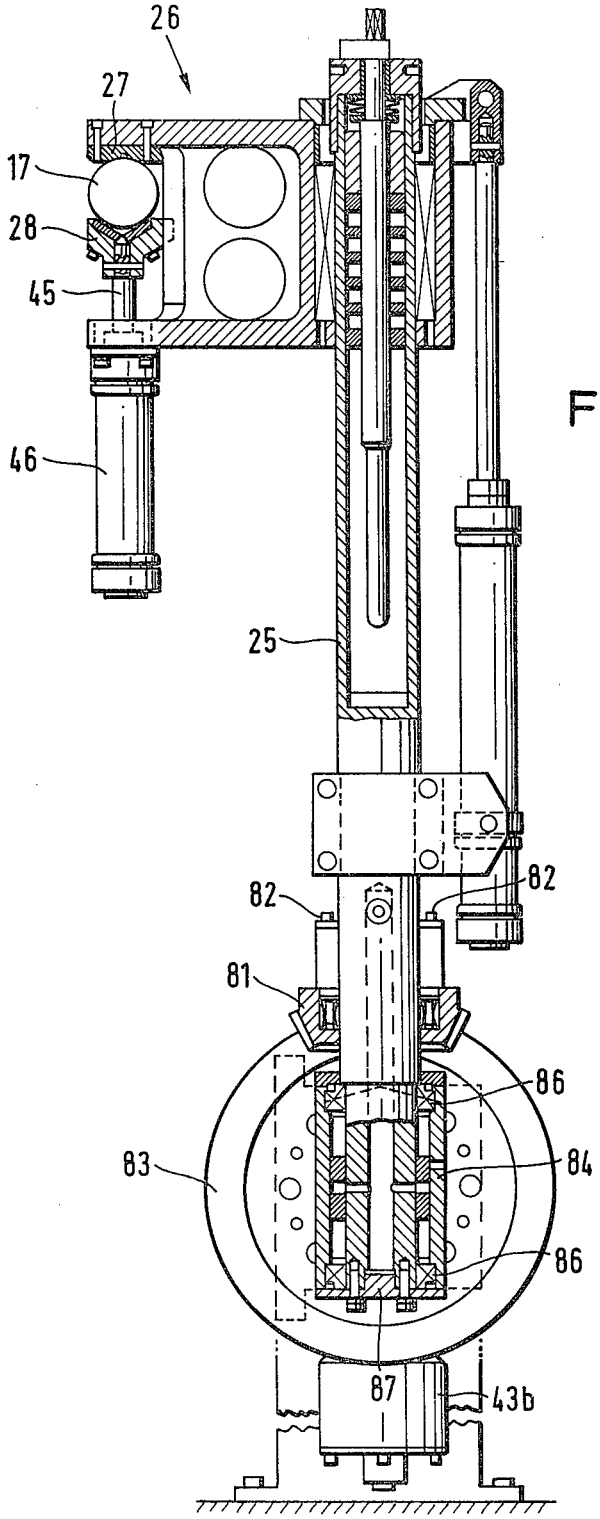
FIG. 14 is a top view of FIG. 13, partly in section.

FIGS. 13 and 14 show a pipe transfer device 19 which is simpler than the one in FIGS. 8 and 9. It again has an upright 21 on which, however, hydraulic pivoting drives 43*a* and 43*b* are provided which are constructed as a structural unit and have a common shaft 23*a* which engages into a shaft 23*b* of the member 21. The front end of the shaft 23 is provided with the tube 25 at the upper end of which the gripper head 26 is mounted. The tube 25 is surrounded by a bevel gear 81 which is fixedly connected to it with screws 82. The bevel gear meshes with a face gear 83 which is vertically mounted and secured to the member 21 via screws 84. The lower end of the tube 25 below the bevel gear 81 is turnable in a housing 85 which is fixedly connected with the shaft 23*b*. For this purpose the housing 85 is provided with appropriate ball bearings 86. A plate screwed to the end of the tube 25 is identified with reference numeral 87 and affords an abutment against axial displacement of the tube.

A gripper 26 is configurated, as shown in FIG. 14, of an upper jaw 27 which is fixed and a lower jaw 28 which is movable relative to the jaw 27 via a piston rod 45 of a cylinder 46. This solution is advantageous if the gripper engages the pipe when the tube 25 is in vertical orientation. The pipe 17 to be bent is then engaged by the jaw 28 and lifted up against the upper stationary jaw 27.

If the supports 39, 39*a* shown in FIG. 5 for the respective next pipe 17 to be gripped and transferred, are located at a high enough level, then the device 19 need not perform the semi-circular movement through 180° in the vertical plane as shown in FIGS. 1–4, but instead need perform only a movement of 90°, i.e. from the position in FIG. 3 to the position in FIG. 4. Assuming this to be the case, and given the starting position in which the tube 25 is vertically oriented, the operation is as follows:

Starting from the vertical position the pipe 17 is clamped between the jaws 27 and 28 and thereafter the drive 23*b* turns the tube 25 with the gripper head 26 about the axis 23 through 90° into the horizontal plane, i.e. from the position in FIG. 3 to the position in FIG. 4. During this movement the bevel gear 81 rolls on the fixed face gear 83, so that the tube 25 which is journalled in the housing 85 for turning movement about its own longitudinal axis, is turned about this longitudinal axis, causing the gripper head to be turned through 180° from the position in FIG. 1 to the position in FIG. 4. These turning movements about the axis 23 and the longitudinal axis of the tube 25 are coordinated with one another by the ratio of the teeth of the bevel gear 81 to those of the face gear 83. The drive 43*a* effects the reverse turning, i.e. lifting of the pipe from the horizontal to the vertical and turning of the tube 25 with the gripper head 26 to the previously mentioned starting position. This solution has the advantage that only a single drive unit having the drives 43*a*, 43*b* need be provided, and that the two motions to be performed can be precisely coordinated with one another.

The present invention assures that the magazine for pipe 17 to be bent can be located fixedly along one side of the pipe bending machine, but nevertheless the pipes can be inserted into the pipe bending machine either from one side or from one end of the same, depending upon whether or not a bending mandrel is to be used. The device 19 can be readily adjusted to the distance between the magazine and the bending machine, since its length can be varied continuously (i.e. not in steps). The device 19 is so constructed that it engages the pipe 17 to be bent very firmly and reliably and maintains it until is engaged by the clamp 13 of the pipe bending machine. This assures, furthermore, that if the pipes 17 have a longitudinally extending welding seam they can be so engated and transported to the machine that the welding seam is pre-oriented with reference to the bending template. Also, the invention assures that the bent pipes can be automatically removed from the machine and a very rapid operating cycle is assured since the removal of a bent pipe is very closely followed by the installation of a new pipe to be bent, because the engagement of the next pipe to be bent in the pipe magazine and its transfer towards the pipe bending machine takes place while the preceding pipe is still being bent in the machine or, at the latest, while the bent pipe is being removed from the machine.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a pipe bending machine, a combination comprising pipe bending means for bending pipes, said pipe bending means being movable between an open position and a pipe clamping and bending position; a pipe magazine spaced laterally from one side of the pipe bending means; pipe transfer means interposed between said pipe magazine and said pipe bending means for transferring pipes from said magazine to said pipe bending means while the latter is in said open position, said pipe transfer means being pivotable in a plurality of mutually inclined planes; and pipe removal means laterally adjacent to an opposite side of said pipe bending means for gripping a bent pipe in said pipe bending means while the latter is in said pipe clamping and bending position and for removing the bent pipe from said pipe bending machine when the latter is in said open position, said pipe removal means also being movable in a plurality mutually inclined planes.

2. A combination as defined in claim 1, said pipe transfer means including a housing, an elongated transfer mechanism mounted on said housing, means for pivoting said mechanism relative to said housing about a substantially horizontal axis, means for pivoting said mechanism about an axis extending lengthwise of said elongation of said mechanism, and means for varying the elongation of said mechanism.

3. A combination as defined in claim 2, said mechanism comprising a tube having a lower end portion mounted in a casing which is in turn mounted in said housing for pivoting about said substantially horizontal axis, a bevel gear fixed to and surrounding a part of said tube, and a face gear mounted in a vertical plane and meshing with said bevel gear and being fixed to said housing.

4. A combination as defined in claim 3, said tube having an upper end portion provided with a gripping head including a stationary jaw, a removable jaw displaceable relative to said stationary jaw, a cylinder-and-piston unit operatively connected with said movable jaw for displacing the same relative to said stationery jaw; and means for displacing said gripping head in the direction lengthwise of said tube.

5. A combination as defined in claim 1, including an elongated bending table having an upper surface, said pipe bending means being mounted on said upper surface and comprising a bending template turnably mounted on said bending table, a first clamp opposite said template and moveable between a retracted and an advanced position for clamping in said advance position a portion of the pipe to be bent during turning of said template, means for moving said first clamp between said positions thereof; and a second clamp spaced in the longitudinal direction of said table from said pipe bending means, a carriage on said upper surface mounting said second clamp movable in the longitudinal direction of said table so that second clamp may engage an end portion of the pipe to be bent to avoid tilting of the pipe during the bending operation.

6. A combination as defined in claim 1, said removal means comprising a pipe removing mechanism mounted for pivoting movement about a substantially vertical axis and including a first arm, and a second arm pivoted to said first arm for pivotal displacement about a vertical axis, and means for varying the length of both of said arms.

7. A combination as defined in claim 6, said varying means carrying a cylinder-and-piston unit articulated to a vertically extending rotary shaft defining said substantially vertical axis, said second arm including a free end portion, a gripping head mounted on said free end portion, and cylinder-and-piston means for operating said gripping head.

8. A combination as defined in claim 7, said removal means including a pair of walls spaced from and extending parallel to one another and each having a front end, a shaft connecting said front ends, a pair of claws each mounted on a different end of said shaft, a U-shaped member having a bight wall extending parallel to said shaft and two leg walls having respective free ends and links each having one end pivoted to one of said free ends, and another end connected to one of said claws, and a cylinder-and-piston unit having a piston rod connected to said bight wall.

* * * * *